United States Patent [19]

Yu

[11] 4,381,172

[45] Apr. 26, 1983

[54] CENTRIPETAL FLOW GAS TURBINE

[75] Inventor: Mason K. Yu, Birmingham, Mich.

[73] Assignee: General Motors Corporation, Detroit, Mich.

[21] Appl. No.: 278,746

[22] Filed: Jun. 29, 1981

[51] Int. Cl.[3] ..... F01D 9/02

[52] U.S. Cl. ..... 415/205; 415/DIG. 1; 415/184; 415/219 C

[58] Field of Search ..... 415/202, 205, 120, 219 C, 415/184, 185, 187, 216, 217, 219 A, DIG. 1; 60/605, 622

[56] References Cited

U.S. PATENT DOCUMENTS

| | | | |
|---|---|---|---|
| 1,483,995 | 2/1924 | Taylor | 415/219 C |
| 1,845,152 | 2/1932 | Hutchinson | 415/219 A |
| 2,685,652 | 8/1954 | Wales | 415/205 X |
| 2,899,797 | 8/1959 | Birmann | 60/605 |
| 3,056,580 | 10/1962 | Swank et al. | 415/184 X |
| 3,190,068 | 6/1965 | Williams et al. | 60/607 |
| 3,442,077 | 5/1969 | Youhouse | 415/187 X |
| 3,930,747 | 6/1976 | Woollenweber | 415/205 |
| 4,007,996 | 2/1977 | Boone | 415/202 X |
| 4,111,598 | 9/1978 | Kasuya | 415/202 |
| 4,351,154 | 9/1982 | Richter | 60/605 |

FOREIGN PATENT DOCUMENTS

| | | | |
|---|---|---|---|
| 309294 | 11/1955 | Switzerland | 415/205 |
| 935231 | 8/1963 | United Kingdom | 415/205 |

*Primary Examiner*—Philip R. Coe
*Assistant Examiner*—Frankie L. Stinson
*Attorney, Agent, or Firm*—Saul Schwartz

[57] ABSTRACT

An improved centripetal flow gas turbine of the type having a housing with a rotor cavity, a rotor rotatably supported in the cavity, a volute chamber around the cavity having a source of motive fluid, and a circular orifice between the volute chamber and the cavity for directing motive fluid at the rotor at a stator exit angle. The improvement resides in the provision of motive fluid manifolds coextensive with the volute chamber and in the provision of louvers connecting the manifolds with the volute chamber whereby streams of motive fluid are injected into the flow of motive fluid in the volute chamber to increase the tangential velocity component thereof and thereby alter the stator exit angle to achieve an improvement in total turbine efficiency.

3 Claims, 4 Drawing Figures

CENTRIPETAL FLOW GAS TURBINE

BACKGROUND OF THE INVENTION

This invention relates generally to gas turbines and, more particularly, to an improvement in nozzleless centripetal turbine assemblies.

A typical centripetal flow gas turbine includes a housing or casing defining a rotor cavity, a rotor rotatably mounted on the housing within the cavity, a volute chamber around the housing, and a circular orifice between the volute chamber and the rotor cavity whereby motive fluid flowing through the volute chamber is directed against the rotor to effect rotation of the latter. Experimental and theoretical analysis of such turbine assemblies has shown that the absolute angle at which the motive fluid passes through the circular orifice and impinges on the rotor, known as the stator exit angle, has a direct and significant effect on the total efficiency of the turbine assembly. The optimum stator exit angle for any particular gas turbine depends upon the physical characteristics of the unit in question and can be determined through known theoretical and/or experimental techniques. Once a desired stator exit angle is established for a particular turbine design, maximum efficiency is obtained if that exit angle is maintained around the full 360° of the circular orifice. One common method of achieving uniform stator exit angle is to form a nozzle around the rotor cavity by inserting stationary vanes in the circular orifice oriented at the desired angle, the nozzle thus functioning to direct the motive fluid at the proper angle. In more sophisticated installations the vanes are adjustable so that the exit angle can be tailored to the speed of the rotor to maximize efficiency over the working speed range of the turbine assembly. Such solutions, however, are not economically attractive for high volume production applications, such as automotive exhaust driven turbochargers, where simpler and less expensive nozzleless turbine assemblies have been traditionally used. Without a nozzle, however, efficiency deteriorates because there is less control of the stator exit angle. A nozzleless gas turbine assembly according to this invention includes provision for improving the stator exit angle and, therefore, represents an improvement over heretofore known nozzleless centripetal flow turbine assemblies.

SUMMARY OF THE INVENTION

The primary feature, then, of this invention is that it provides an improved centripetal flow nozzleless gas turbine assembly. Another feature of this invention is that it provides an improved nozzleless gas turbine assembly wherein the stator exit angle of the motive fluid is improved through simple enhancement of the tangential velocity of the motive fluid in the volute chamber. A still further feature of this invention resides in the provision in the improved nozzleless gas turbine assembly of a motive fluid manifold generally coextensive with the volute chamber and a plurality of louvers between the manifold and the volute chamber operative to inject streams of motive fluid into the volute chamber to enhance the tangential velocity of the motive fluid swirl in the volute chamber thereby to improve the stator exit angle of the motive fluid and the total efficiency of the gas turbine assembly. Yet another feature of this invention resides in the provision in the improved nozzleless gas turbine assembly of a motive fluid manifold fabricated integrally with the volute chamber generally coextensive therewith and having a common separating wall through which are cast a plurality of louvers for directing streams of motive fluid into the volute to enhance the tangential velocity of the swirl of motive fluid in the volute chamber.

These and other features of this invention will be readily apparent from the following specification and from the drawings wherein.

Figure 1:
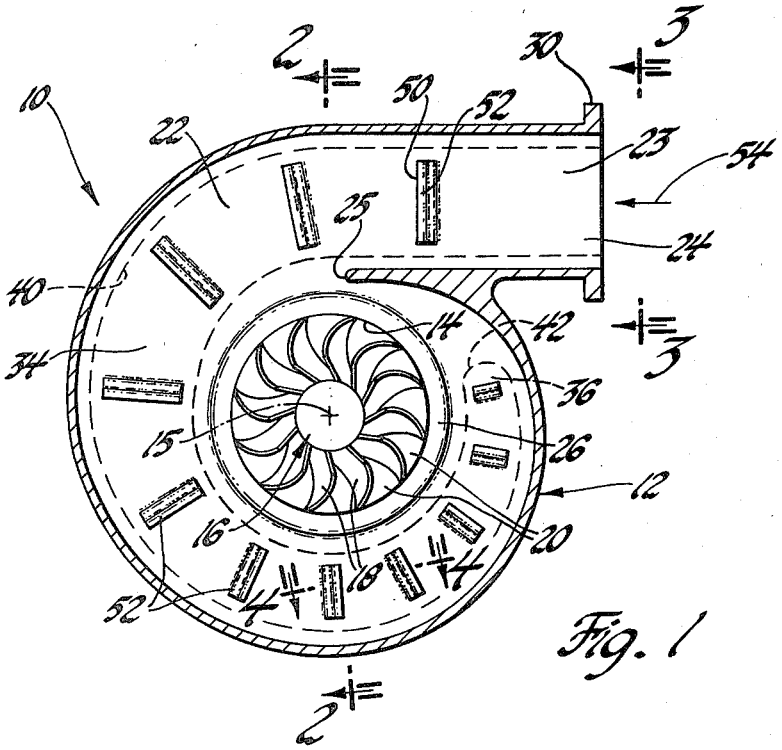
FIG. 1 is a sectional view of a nozzleless gas turbine assembly according to this invention.
Figure 2:
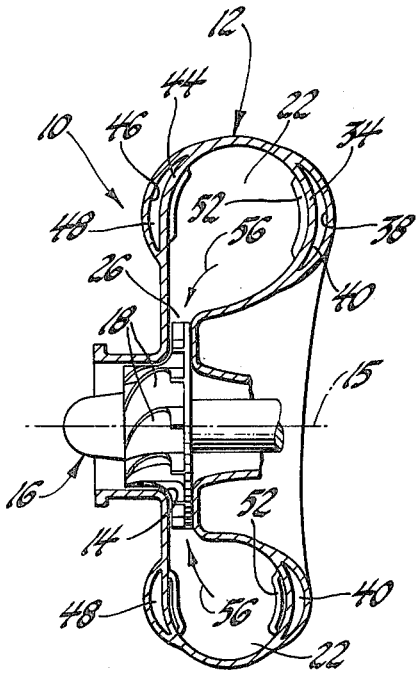
FIG. 2 is a sectional view taken generally along the plane indicated by lines 2—2 in FIG. 1.

Referring now to FIGS. 1 and 2 of the drawings a gas turbine according to this invention and designated generally 10 is shown in an exhaust driven turbocharger embodiment. The gas turbine 10 includes a housing 12 defining a centrally located rotor cavity 14. Supported by conventional means, not shown, for rotation about an axis 15 of the housing within the rotor cavity 14 is a turbine rotor 16 having a plurality of integral turbine vanes 18. The rotor 16 is connected to a compressor rotor, not shown, which functions in known manner to supply pressurized air to the intake manifold of the turbocharged engine. The turbine rotor 16 cooperates with the rotor cavity 14 and the turbine vanes 18 in defining a plurality of centripetal flow passages 20 which rotate with the rotor.

The housing 12 further defines a volute chamber 22 disposed in a plane perpendicular to the axis 15. The volute chamber has a cylindrical inlet section 23 extending from a circular mouth 24 to a point 25 where the innermost edge of the inlet section approaches tangency with the rotor cavity. The volute chamber then extends a full 360° around the rotor cavity and has a generally circular cross section of progressively smaller diameter. The volute chamber terminates approximately at the point 25, FIG. 1. Between the volute chamber 22 and the rotor cavity 14, the housing 12 defines a circular orifice 26, FIG. 2, also extending a full 360° around the rotor cavity and providing communication between the volute chamber and the rotor cavity in known fashion. A flange 30 integral with the housing 12 extends around the mouth 24 and includes a plurality of holes 32 by means of which the volute chamber 22 may be connected to a source of motive fluid, as for example the exhaust manifold of an internal combustion engine.

Figure 3:
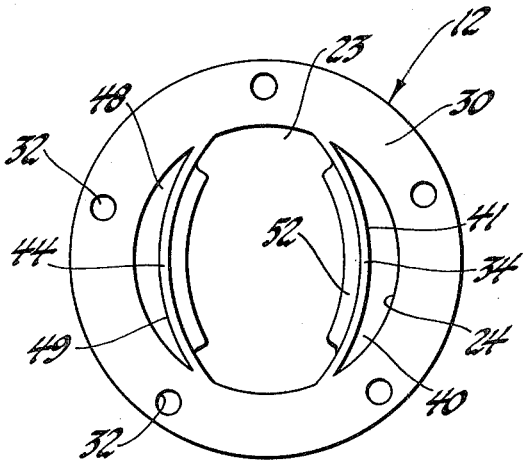
FIG. 3 is a view taken generally along the plane indicated by lines 3—3 in FIG. 1.

With particular reference now to FIGS. 1, 2 and 3, formed integrally with the housing 12 is a first internal partition wall 34 which extends from the mouth 24 of the volute chamber, along the inlet section 23, and then substantially the full 360° around the rotor cavity 14 until space considerations at the small cross sectional area end of the volute chamber dictate merging of the partition wall with the inner surface of the volute chamber at 36. The first partition wall 34 thus cooperates with an adjacent portion 38 of the internal surface of the volute chamber in defining a first manifold 40 generally coextensive with the volute chamber 22 and extending from an open end 41, FIG. 3, at the mouth 24 of the volute chamber to a closed end 42 at the merger 36 of the partition wall and the inner surface of the volute chamber. Similarly, a second partition wall 44 formed integrally with the housing 12 is disposed generally opposite the first partition wall 34 in the volute chamber 22. The second partition wall cooperates with a second adjacent portion 46 of the inner surface of the volute chamber in defining a second manifold 48 extending from an open end 49 adjacent the mouth 24 of the volute chamber, around the rotor cavity 14 to a closed end corresponding generally to the closed end 42 of the first manifold.

Figure 4:
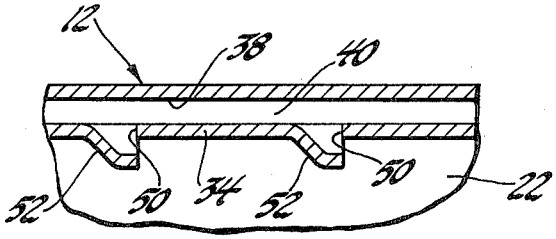
FIG. 4 is a sectional view taken generally along the plane indicated by lines 4—4 in FIG. 1.

As seen best in FIGS. 1 and 4, the first partition wall 34 has a plurality of apertures 50 formed therein each of which is shrouded by an integral raised portion 52 of the partition wall 34. The raised portions 52 cooperate with the apertures 50 in defining a plurality of louvers providing communication between the first manifold 40 and the volute chamber 22. A similar plurality of apertures and raised portions are located on the second partition wall 44 and also define a plurality of louvers communicating between the volute chamber 22 and the second manifold 48.

Describing now the operation of the turbine 10, in an exhaust gas turbocharger application the housing 12 is attached at the flange 30 to the exhaust manifold of the internal combustion engine. The engine thus provides a supply of hot gas motive fluid flowing in the direction indicated by arrow 54, FIG. 1, at a velocity proportional to the speed of the engine. The flow of motive fluid, of course, divides at the mouth 24 between the first and second manifolds 40 and 48 and the volute chamber 22, the majority of the motive fluid flowing into the volute chamber. The volute chamber directs the motive fluid around the circumference of the rotor cavity generally in a spiral swirl about the axis 15. Commencing at the termination of the inlet portion 23 of the volute chamber, the circular orifice 26 provides direct communication between the volute chamber and the rotor cavity so that the motive fluid escapes generally radially inwardly around the rotor cavity through the circular orifice as indicated at arrow 56, FIG. 2, thereafter to impinge on the turbine vanes 18 causing rotation of the turbine rotor 16 in conventional manner.

At each finite location around the circular orifice the configuration of the volute chamber 22 dictates that the motive fluid have a velocity component directed tangent to the circumference of the rotor 16 and a radial component directed at the axis 15 of the rotor. The stator exit angle of the motive fluid through the circular orifice 26 is determined by the summation of the tangential and radial velocity components and, in the absence of other influences, is directly related to the initial velocity of the motive fluid and the physical design of the volute chamber 22 and the circular orifice 26. Typically, in nozzleless turbines the tangential component of velocity tends to diminish as the motive fluid proceeds along the length of the volute chamber and, accordingly, the stator exit angle tends to direct the motive fluid more nearly in the radial direction. To compensate for the decrease in tangential velocity the louvers defined by the apertures 50 and the raised portions 52 in the first partition wall 34 and the corresponding louvers in the second partition wall 44 function to inject motive fluid from the first and second manifolds 40 and 48 into the volute chamber in a direction generally tangent to the circumference of the rotor and the circular orifice 26. The motive fluid in the manifolds is not subject to the same degree of tangential velocity degradation as the motive fluid in the volute chamber because none of the motive fluid escapes in the radial direction so that the motive fluid thus injected functions to increase the tangential velocity component of the motive fluid in the volute chamber to alter and improve the stator exit angle. The amount by which the stator exit angle is altered, of course, depends upon the number of louvers provided, their location, and the physical characteristics of the louvers such as directional orientation, flow area, aperture size, and the degree to which the raised portions overlap the apertures. For optimum performance, each of these various physical characteristics must be determined empirically in each individual application.

The foregoing description of the preferred embodiment including two manifolds located on opposite sides of the volute chamber will suggest numerous optional constructions within the scope of the invention such as substitution of a single manifold extending around some desired portion of the internal surface of the volute chamber. Similarly, numerous fabrication techniques suggest themselves for forming the manifolds in the volute chamber in addition to the unitary casting described. Finally, a further refinement of the effect of injection of motive fluid from the manifolds can be achieved by providing simple gating at the open ends 41 and 49 to control the amount of motive fluid entering either or both of the manifolds. Again empirical evaluation is necessary to achieve optimum efficiency improvement.

The embodiments of the invention in which an exclusive property or privilege is claimed are defined as follows:

1. In a nozzleless centripetal flow turbine assembly including a housing defining a rotor cavity, a turbine rotor disposed in said cavity and supported on said housing for rotation about a first axis thereof, a volute chamber disposed in a plane generally perpendicular to said first axis having an inlet for motive fluid at one end and extending substantially 360° around said rotor cavity, and a nozzleless circular orifice between said volute chamber and said rotor cavity for directing motive fluid against said turbine rotor at a stator exit angle, the improvement comprising, means defining a manifold chamber generally coextensive with said volute chamber and having a closed end and an open end adapted to receive said motive fluid, and louver means connecting said manifold chamber and said volute chamber operative to effect injection of at least one stream of motive fluid from said manifold chamber into the flow of motive fluid in said volute chamber thereby to alter said stator exit angle of said motive fluid for improvement of overall turbine efficiency.

2. In a nozzleless centripetal flow turbine assembly including a housing defining a rotor cavity, a turbine rotor disposed in said cavity and supported on said housing for rotation about a first axis thereof, a volute chamber disposed in a plane generally perpendicular to said first axis having an inlet for motive fluid at one end and extending substantially 360° around said rotor cavity, and a nozzleless circular orifice between said volute chamber and said rotor cavity for directing motive fluid drivingly against said turbine rotor at a stator exit angle, the improvement comprising, wall means disposed in said volute chamber defining therewith a manifold chamber generally coextensive with said volute chamber having a closed end and an open end located generally at said volute chamber inlet for simultaneous reception of motive fluid with said volute chamber, and means defining a plurality of louvers in said wall means connecting said manifold chamber and said volute chamber operative to effect injection of a plurality of streams of motive fluid from said manifold chamber into the flow of motive fluid in said volute chamber thereby to alter said stator exit angle of said motive fluid for improvement of overall turbine efficiency.

3. In a nozzleless centripetal flow turbine assembly including a housing defining a rotor cavity, a turbine rotor disposed in said cavity and supported on said housing for rotation about a first axis thereof, a volute chamber disposed in a plane generally perpendicular to said first axis having an inlet for motive fluid at one end and extending substantially 360° around said rotor cavity, and a nozzleless circular orifice between said volute chamber and said rotor cavity for directing motive fluid drivingly against said turbine at a stator exit angle, the improvement comprising, a pair of partition walls disposed in said volute chamber generally on opposite sides thereof defining therewith a pair of manifolds each generally coextensive with said volute chamber and having a closed end and an open end located generally at said volute chamber inlet for simultaneous reception of motive fluid with said volute chamber, means defining a plurality of slots in each of said partition walls providing connection between each of said manifold chambers and said volute chamber, and a plurality of shrouds disposed over respective ones of said slots and cooperating therewith in defining a corresponding plurality of louvers operative to effect injection of streams of motive fluid from each of said manifold chambers into the flow of motive fluid in said volute chamber thereby to alter said stator exit angle of said motive fluid for improvement of overall turbine efficiency.

* * * * *